US011846409B2

(12) United States Patent
Pitcher et al.

(10) Patent No.: US 11,846,409 B2
(45) Date of Patent: Dec. 19, 2023

(54) FIELD CONFIGURABLE FLAGPOLE TRUCK SYSTEM AND DEVICE

(71) Applicants: Daniel J. Pitcher, Wimberley, TX (US); Lisa M. Pitcher, Wimberley, TX (US)

(72) Inventors: Daniel J. Pitcher, Wimberley, TX (US); Lisa M. Pitcher, Wimberley, TX (US)

( * ) Notice: Subject to any disclaimer, the term of this patent is extended or adjusted under 35 U.S.C. 154(b) by 112 days.

(21) Appl. No.: 17/693,008

(22) Filed: Mar. 11, 2022

(65) Prior Publication Data

US 2023/0288048 A1 Sep. 14, 2023

(51) Int. Cl.

| | |
|---|---|
| ***F21V 21/116*** | (2006.01) |
| ***F21S 8/08*** | (2006.01) |
| ***E04H 12/32*** | (2006.01) |
| ***G09F 17/00*** | (2006.01) |

(52) U.S. Cl.

CPC ..... *F21V 21/116* (2013.01); *E04H 12/32* (2013.01); *F21S 8/088* (2013.01); *G09F 17/00* (2013.01); *G09F 2017/0025* (2013.01)

(58) Field of Classification Search

CPC ..... F21V 21/116; E04H 12/32; F21S 8/088; G09F 17/00; G09F 2017/0025

USPC ..... 248/511; 116/173

See application file for complete search history.

(56) References Cited

U.S. PATENT DOCUMENTS

| | | | | |
|---|---|---|---|---|
| 3,923,001 | A * | 12/1975 | Murdock | G09F 17/00 116/173 |
| 3,976,283 | A * | 8/1976 | Schmit | B66D 1/04 74/528 |
| 5,096,022 | A * | 3/1992 | Bowers | G09F 17/00 188/65.1 |
| 6,955,456 | B2 * | 10/2005 | Schroeder | G09F 17/00 362/253 |
| 7,699,508 | B2 * | 4/2010 | Schroeder | G09F 17/00 362/431 |
| 8,286,575 | B2 | 10/2012 | Somers | |
| 10,787,833 | B1 * | 9/2020 | Apel | E04H 12/32 |
| 10,808,913 | B1 | 10/2020 | Pitcher et al. | |
| 2021/0005119 | A1 | 1/2021 | Roy | |

* cited by examiner

*Primary Examiner* — Anita M King

(74) *Attorney, Agent, or Firm* — Olav M. Underdal; IDP Patent Services

(57) ABSTRACT

A flagpole truck system includes a flag pole truck device, including an enclosure body with a blocking protrusion, first and second pulley mounts, first and second halyard apertures, and internally mounted pulley assembly, a mounting stem assembly with first and second pin apertures, first and second blocking pins; a flagpole; a flag; a halyard; and a flag pole finial; such that the flag pole truck device is configurable in a first configuration for external halyard mounting and in a second configuration for partially internal halyard mounting; and such that the flag pole truck device is configurable for free rotation, restricted rotation, and blocked rotation.

25 Claims, 11 Drawing Sheets

Flagpole truck system

Flagpole truck system

FIELD CONFIGURABLE FLAGPOLE TRUCK SYSTEM AND DEVICE

CROSS-REFERENCE TO RELATED APPLICATIONS

N/A.

FIELD OF THE INVENTION

The present invention relates generally to the field of flagpole accessories, and more particularly to methods and systems for flagpole trucks for mounting on a top of a flagpole.

BACKGROUND OF THE INVENTION

Flagpoles are typically configured with a top-mounted flagpole truck, which provided means for mounting flag finial and for containing a pulley to which a flag halyard attaches.

However, such flagpole trucks are designed for either internal or external halyard mounting and have only limited options for rotational support. Therefore, changing mounting or rotational configuration is effectively impossible without replacement of the flagpole truck. Add, conventional external halyard mounts position the pulley displaced to a side of the flag truck body, such that the pulley is visible and exposed to the ambient environment.

As such, considering the foregoing, it may be appreciated that there continues to be a need for novel and improved devices and methods for field configurable flagpole trucks.

SUMMARY OF THE INVENTION

The foregoing needs are met, to a great extent, by the present invention, wherein in aspects of this invention, enhancements are provided to the existing model of flagpole trucks.

In an aspect, a field configurable flagpole truck system can include:

a) A flagpole, such that a lower end of the flagpole can be mounted on a ground surface;

b) A flagpole truck device, which is mounted on a top end of the flagpole, wherein the flagpole truck device, comprises a pulley assembly mounted inside an enclosure interior of the flagpole truck device;

c) A flag, which is mounted on a top part of the flagpole;

d) A halyard, which is connected to the flagpole truck device, around the pulley assembly, and connected to the flag, such that a movement of the halyard enables positioning of the flag; and e) A flagpole finial, which can be connected to a top of the flagpole truck device;

such that the flagpole truck device can be configured in a first configuration, wherein the pulley assembly is positioned in a first position, such that first and second ends of the halyard each protrude downward from the flagpole truck device, such that the first and second ends of the halyard each protrude downward externally and visibly, to a side of the flagpole; and such that the flagpole truck device can be configured in a second configuration, wherein the pulley assembly is positioned in a second position, such that the first end of the halyard protrudes downward from the flagpole truck device externally and visibly, to a side of the flagpole, and the second end of the halyard protrudes downward from the flagpole truck device inside of an upper portion of the hollow flagpole.

In a related aspect, the flagpole truck device can include a blocking protrusion, which is connected to a bottom of the enclosure body; and a mounting stem structure of the flagpole truck device can include a first pin aperture and a second pin aperture, which is horizontally displaced to a side of the first pin aperture; and wherein the mounting stem assembly can further include:

a) a first blocking pin, which is configured to be inserted into the first pin aperture, such that the first blocking pin protrudes horizontally from the mounting stem structure, such that the first blocking pin is configured to impact with the blocking protrusion to stop a rotation of the mounting stem assembly relative to the enclosure body; and b) a second blocking pin, which is configured to be inserted into the second pin aperture, such that the second blocking pin protrudes horizontally from the mounting stem structure to a side of the first blocking pin with a separation distance between the first blocking pin and the second blocking pin, such that the second blocking pin is configured to impact with the blocking protrusion to stop a rotation of the mounting stem assembly relative to the enclosure body;

such that when neither of the first blocking pin and the second blocking pin are inserted in either of the first pin aperture and the second pin aperture, the mounting stem assembly is rotatable 360 degrees freely in either direction, whereby the enclosure body of the flagpole truck device is freely rotatable when the flagpole truck device is mounted on the flagpole;

such that when solely one selected blocking pin is inserted in a selected pin aperture, the mounting stem assembly is rotatable in a restricted rotation range in either direction, wherein the restricted rotation range can be 359 degrees or less, whereby the enclosure body of the flagpole truck device is rotatable in the restricted rotation range when the flagpole truck device is mounted on the flagpole; and such that when the first blocking pin is inserted in the first pin aperture, and the second blocking pin is inserted in the second pin aperture, with the blocking protrusion positioned between the first blocking pin and the second blocking pin, the mounting stem assembly can be prevented from rotating, whereby the enclosure body of the flagpole truck device is rotatably fixed in position when the flagpole truck device is mounted on the flagpole.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
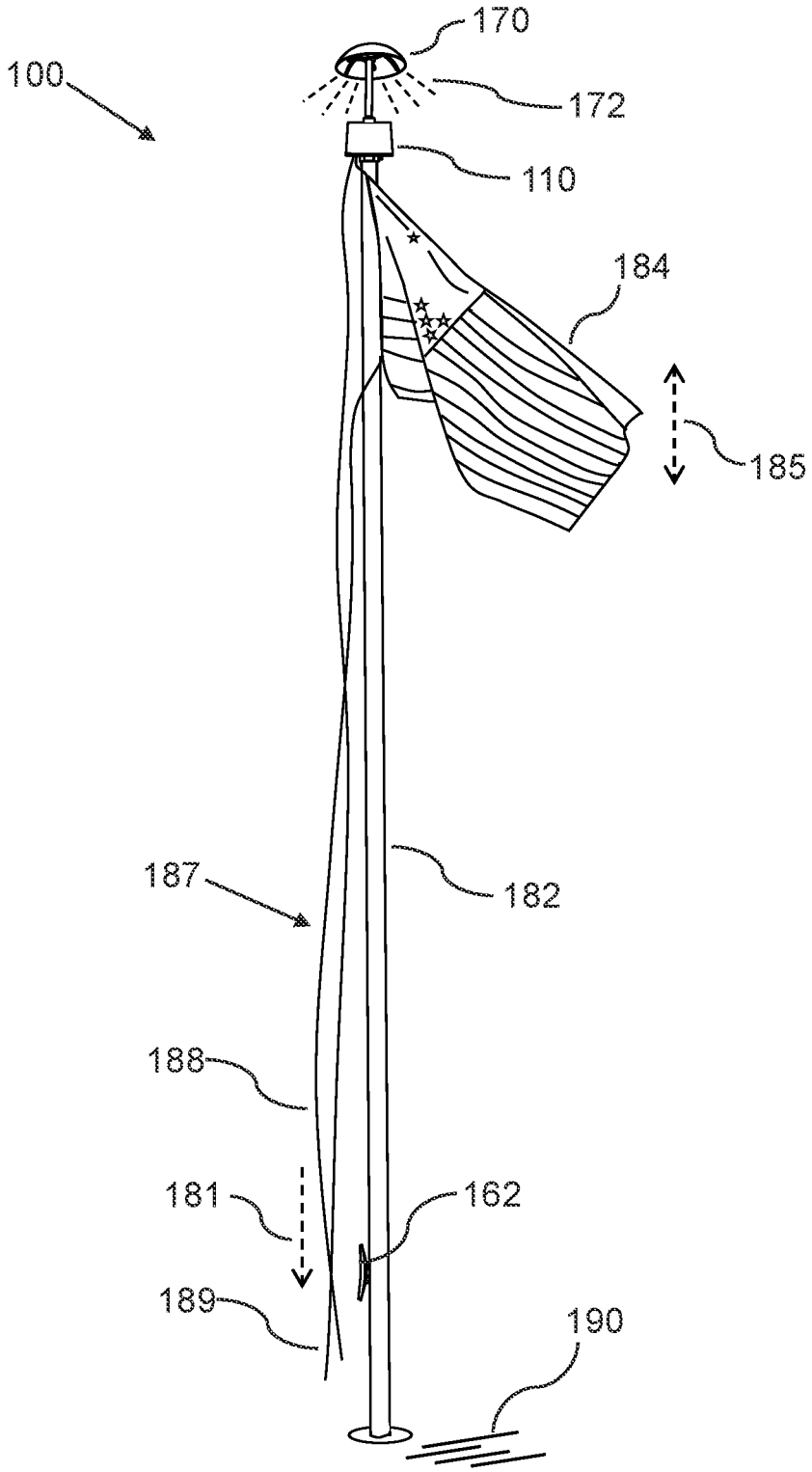
FIG. 1A is a perspective view of a flagpole truck system in a first configuration with external halyard mounting, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a flagpole truck system 100 with reference to FIG. 1, in such manner that like reference numerals refer to like components throughout; a convention that we shall employ for the remainder of this specification.

Figure 1B:
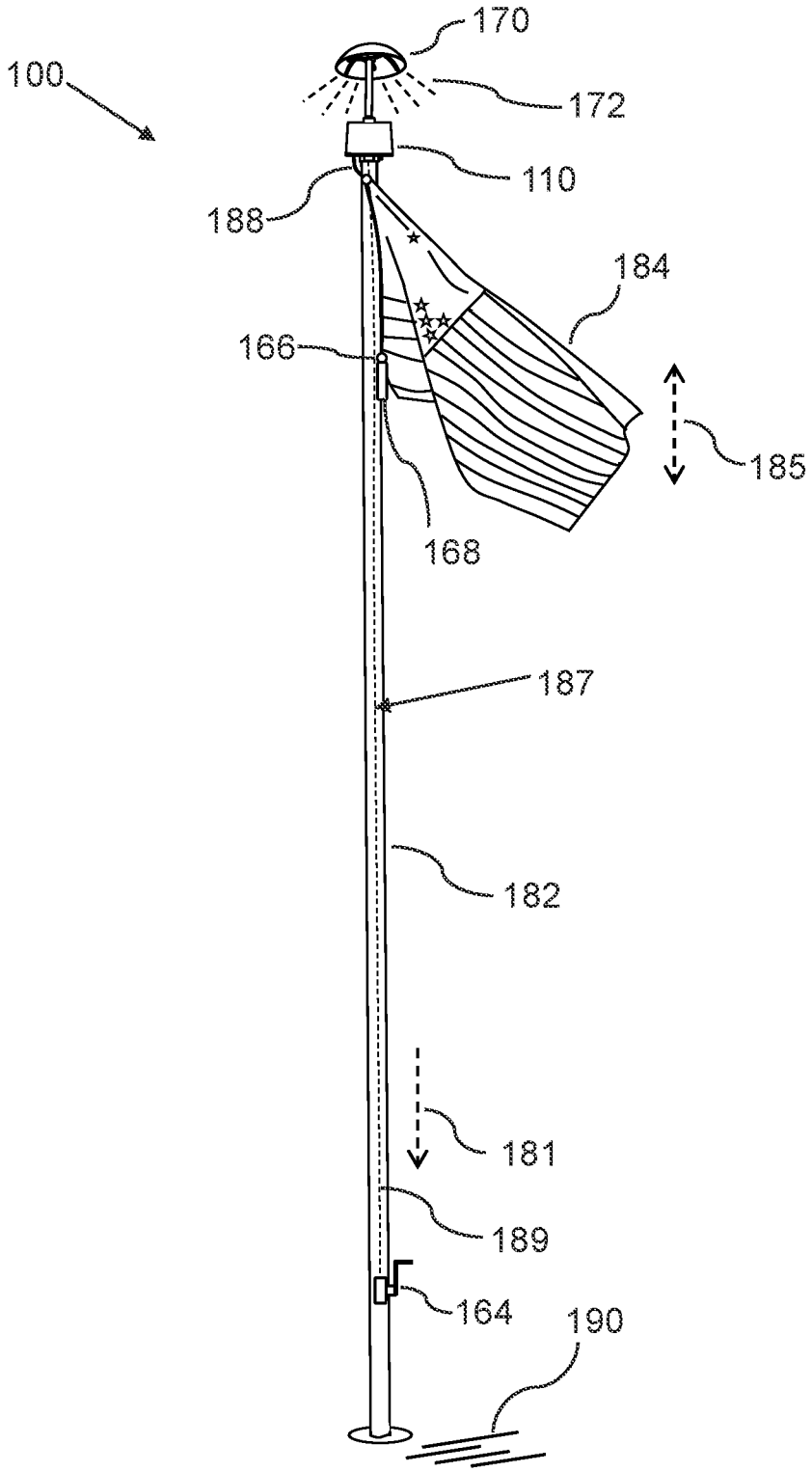
FIG. 1B is a perspective view of a flagpole truck system in a second configuration with partially internal halyard mounting, according to an embodiment of the invention.
Figure 3A:
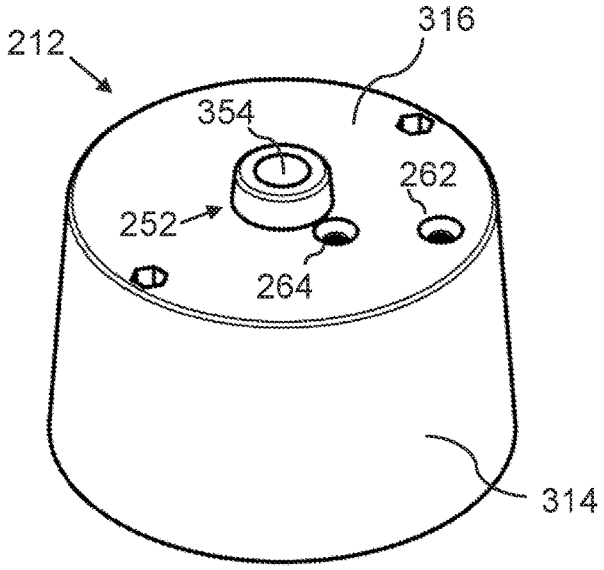
FIG. 3A is a top perspective view of an upper body portion of a flagpole truck device, according to an embodiment of the invention.
Figure 3B:
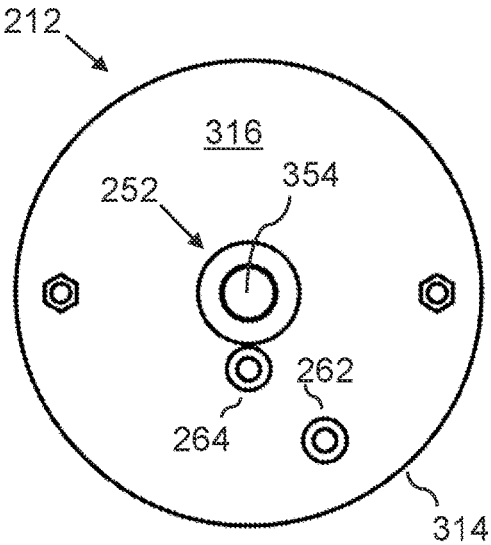
FIG. 3B is a top view of an upper body portion of a flagpole truck device, according to an embodiment of the invention.
Figure 3C:
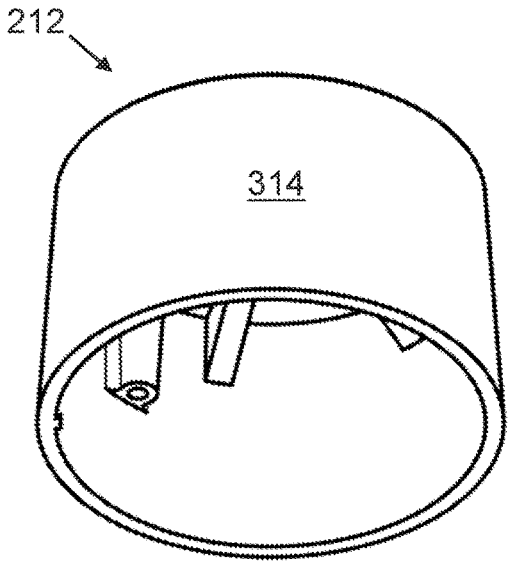
FIG. 3C is a bottom perspective view of an upper body portion of a flagpole truck device, according to an embodiment of the invention.
Figure 3D:
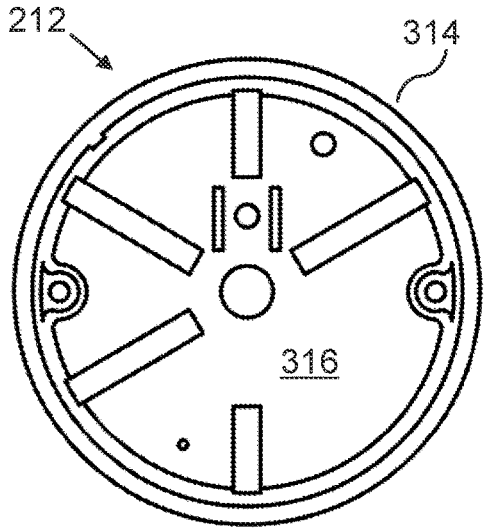
FIG. 3D is a bottom view of an upper body portion of a flagpole truck device, according to an embodiment of the invention.
Figure 3E:
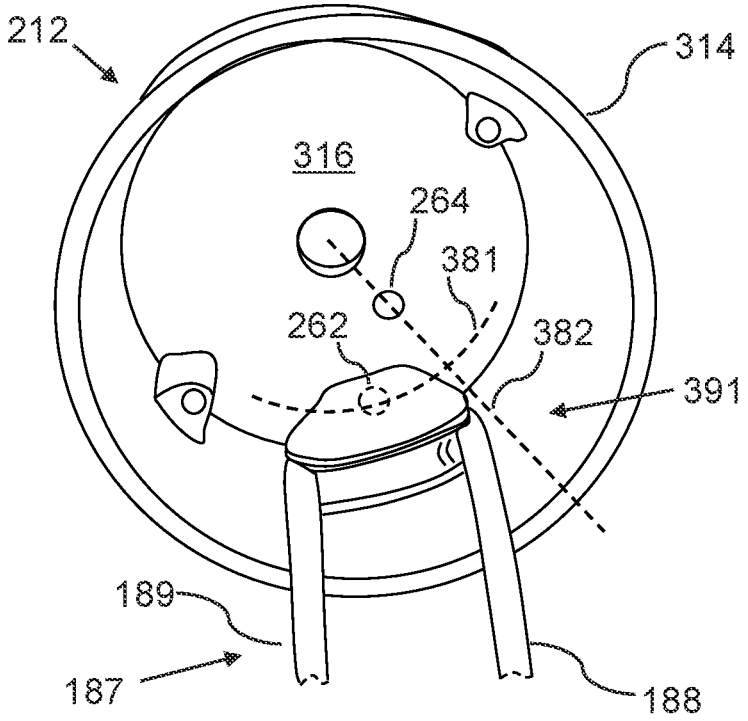
FIG. 3E is a bottom perspective view of an upper body portion of a flagpole truck device with a pulley assembly mounted in a first position for an external halyard configuration, according to an embodiment of the invention.
Figure 3F:
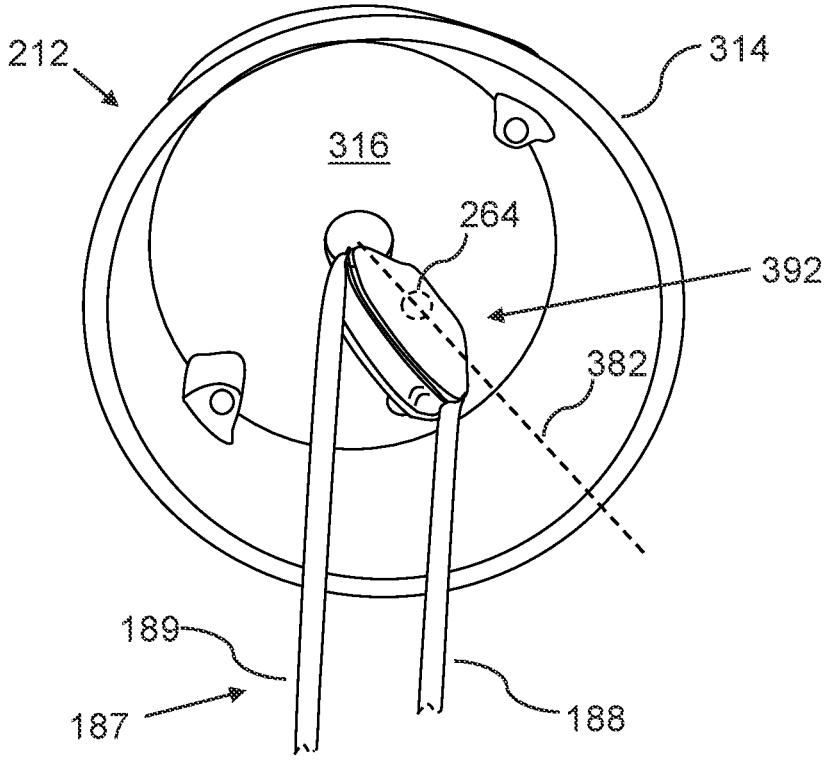
FIG. 3F is a bottom perspective view of an upper body portion of a flagpole truck device with a pulley assembly mounted in a second position for a partially internal halyard configuration, according to an embodiment of the invention.
Figure 4A:
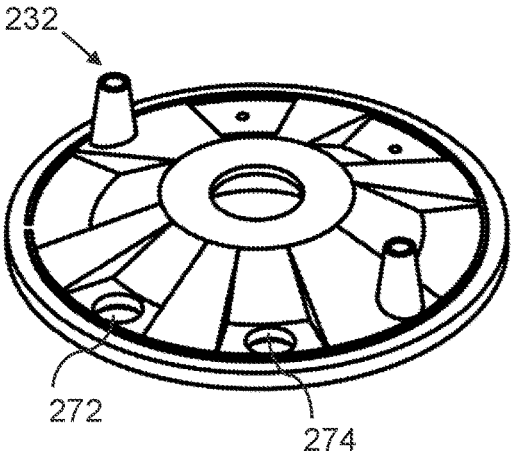
FIG. 4A is a top perspective view of a bottom base plate of a flagpole truck device, according to an embodiment of the invention.
Figure 4B:
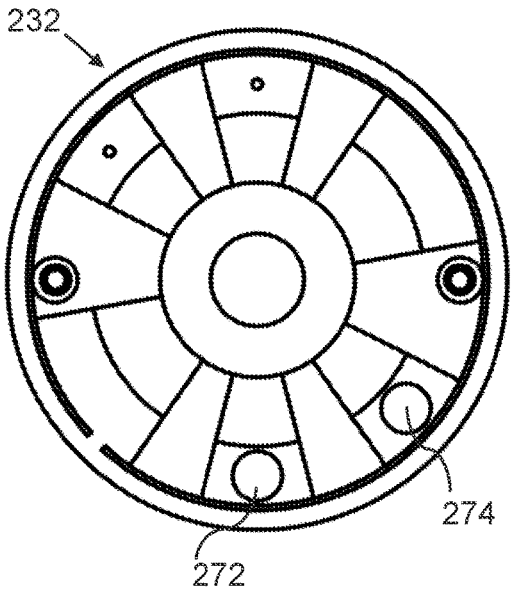
FIG. 4B is a top view of a bottom base plate of a flagpole truck device, according to an embodiment of the invention.
Figure 4C:
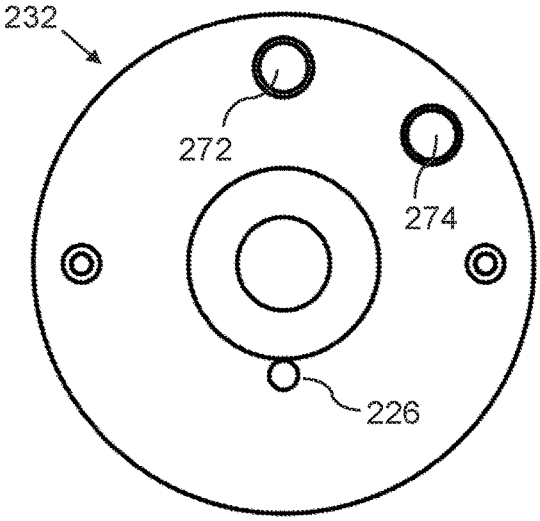
FIG. 4C is a bottom view of a bottom base plate of a flagpole truck device, according to an embodiment of the invention.
Figure 4D:
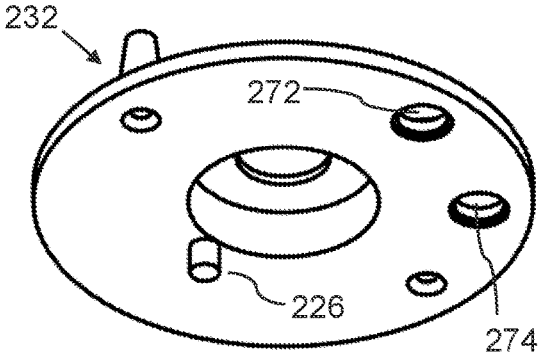
FIG. 4D is a bottom perspective view of a bottom base plate of a flagpole truck device, according to an embodiment of the invention.
Figure 4E:
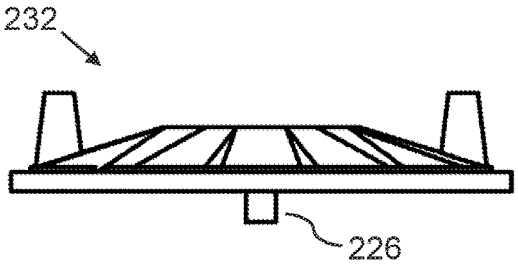
FIG. 4E is a side view of a bottom base plate of a flagpole truck device, according to an embodiment of the invention.
Figure 5A:
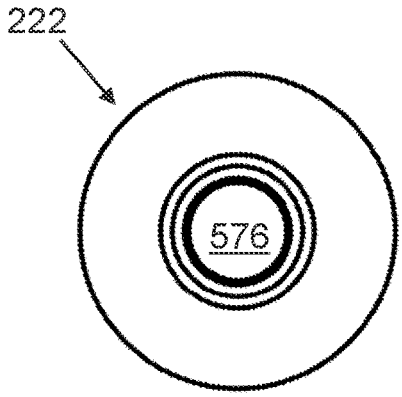
FIG. 5A is a top view of a mounting stem structure of a flagpole truck device, according to an embodiment of the invention.
Figure 5B:
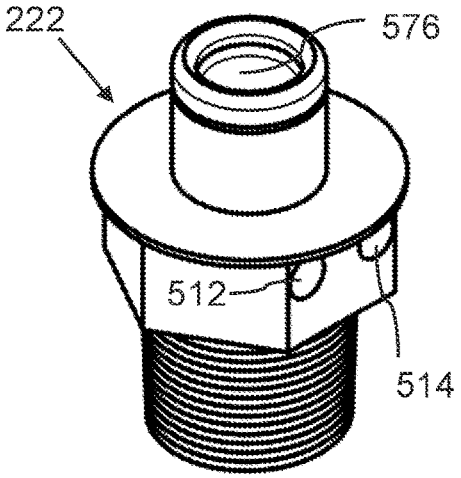
FIG. 5B is a top perspective view of a mounting stem structure of a flagpole truck device, according to an embodiment of the invention.
Figure 5C:
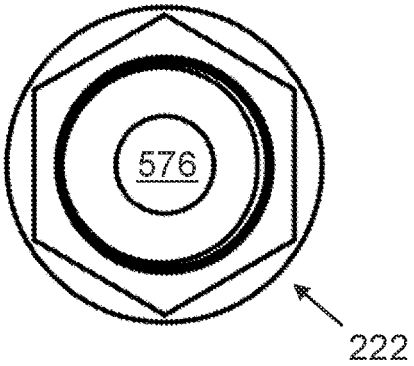
FIG. 5C is a bottom view of a mounting stem structure of a flagpole truck device, according to an embodiment of the invention.
Figure 5D:
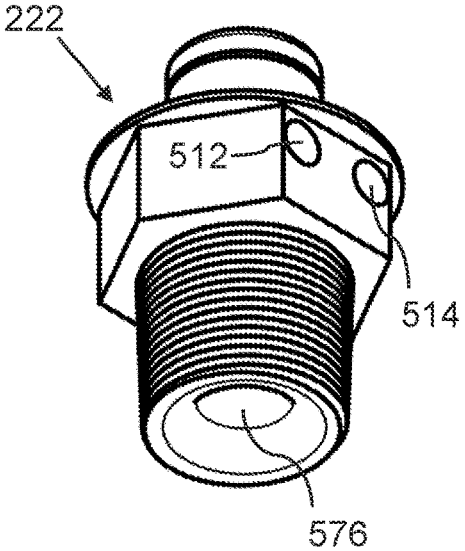
FIG. 5D is a bottom perspective view of a mounting stem structure of a flagpole truck device, according to an embodiment of the invention.
Figure 6A:
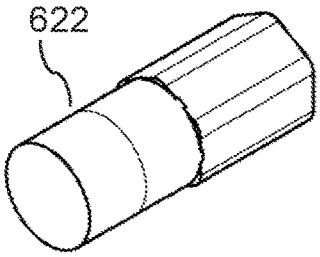
FIG. 6A is a rear perspective view of a blocking pin of a mounting stem assembly of a flagpole truck device, according to an embodiment of the invention.
Figure 6B:
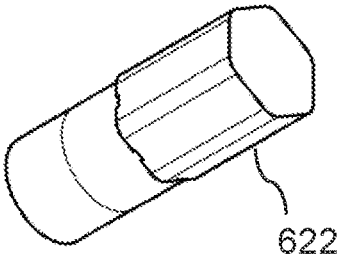
FIG. 6B is a front perspective view of a blocking pin of a mounting stem assembly of a flagpole truck device, according to an embodiment of the invention.

In an embodiment, as shown in FIGS. 1A and 1B, a field configurable flagpole truck system 100 can include:

a) A flagpole 182, such that a lower end of the flagpole 182 can be mounted on a ground surface 190;

b) A flagpole truck device 110, which is mounted (i.e., configured to mount/be mountable) on a top end of the flagpole 182, wherein the flagpole truck device 110, comprises a pulley assembly 230 mounted inside an enclosure interior 216 of the flagpole truck device 110.

c) A flag 184, which is mounted on a top part of the flagpole 182;

d) A halyard 187, which is connected to the flagpole truck device 110, around the pulley assembly 230, and connected to the flag 184, such that a movement 181 of first or second ends 188, 189 of the halyard 187 enables positioning 185 of the flag 184; and e) A flagpole finial 170, which can be connected to a top of the flagpole truck device 110;

such that the flagpole truck device 110 can be configured in a first configuration, as shown in FIG. 1A, wherein the pulley assembly 230 is positioned in a first position 391 (as shown in FIG. 3E), such that a first end 188 (of the halyard 187) and a second end 189 of the halyard 187 each protrude downward from the flagpole truck device 110 externally and visibly, to a side of the flagpole 182, such that the first and second ends 188, 189 of the halyard 187 can be tied to a cleat mount 162 on a bottom portion of the flagpole 182; and such that the flagpole truck device 110 can be configured in a second configuration, as shown in FIG. 1B, wherein the pulley assembly 230 is positioned in a second position 392 (as shown in FIG. 3F), such that the first end 188 of the halyard 187 protrudes downward from the flagpole truck device 110 externally and visibly, to a side of the flagpole 182, such that an outer end of the first end 188 of the halyard 187 can be connected to a flag retaining ring 166 of the flag 184, such that a lower inner portion of the flag 184 can be held down with a counterweight 168, which aids in lowering the flag 184;

such that the second end 189 of the halyard 187 protrudes downward from the flagpole truck device 110 inside of an upper portion of the hollow flagpole 182, such that an outer end of the second end 189 of the halyard 187 can connect inside the hollow flagpole 182 to an internal cam cleat or an internal portion of a winch assembly 164.

In a related embodiment, the flagpole finial 170 can be configured as a flagpole lighting device 170, such that the flagpole lighting device 170 emits light 172 to illuminate the flag 184. The flagpole lighting device 170 can be configured as described in U.S. Pat. No. 10,808,913, titled "Flagpole lighting system and device", issued Oct. 20, 2020; which is hereby incorporated herein by reference in its entirety.

In a related embodiment, as shown in FIGS. 2A-2H, 3A-3D, and 4A-4E, the flagpole truck device 110 can include:

a) An enclosure body 211, which comprises an enclosure interior 216;

b) A pulley assembly 230, which is positioned inside the enclosure body, wherein the pulley assembly 230 is configured for use with the halyard 187; and c) A mounting stem assembly 220, which can include:

i. A mounting stem structure 222, which comprises (i.e., is configured with) an outer threading 224 on a lower portion of the mounting stem structure 222;

wherein an upper end of the mounting stem structure 222 is rotatably connected to a bottom center of the enclosure body 211;

wherein the mounting stem structure is connected to a top end of the flagpole 182, such that the outer threading 224 of the lower portion of the mounting stem structure 222 is screwed into a threaded aperture of a top end of the flagpole 182, such that the enclosure body 211 is rotatably connected to the top end of the flagpole 182.

In a related embodiment, as shown in 3A and 3B, the enclosure body 211 can further include:

a) an upper body portion 212, which can include:

i. a peripheral sidewall 314, which can be substantially cylindrical with a widening diameter from a top to a bottom of the peripheral sidewall 314; and ii. a top plate 316, which can be mounted on a top of the peripheral sidewall 314; and b) a bottom base plate 232, which can be connected to a bottom of the peripheral sidewall 314 of the upper body portion 212;

such that the enclosure interior 216 is formed between the upper body portion 212 and the bottom base plate 232, i.e. between the top plate 316, peripheral sidewall 314, and the bottom base plate 232.

In a related embodiment, as shown in 3A and 3B, the flagpole truck device 110 can further include:

a) a top mounting structure 252, which can be connected to a center of a top of the upper body portion 212;

wherein the top mounting structure 252 comprises a central aperture 354, which can be a threaded central aperture 354; such that the top mounting structure is configured to receive a lower portion of the flagpole finial 170, such that the lower portion of the flagpole finial 170 can be inserted into the central aperture 354, such that the lower portion of the flagpole finial 170 can be screwed into the central aperture 354; and b) a top mounting cap 258, which is configured to cover the central aperture 354, for use of the top mounting structure 252 without a flagpole finial 170 mounted on the top mounting structure 252.

Figure 2A:
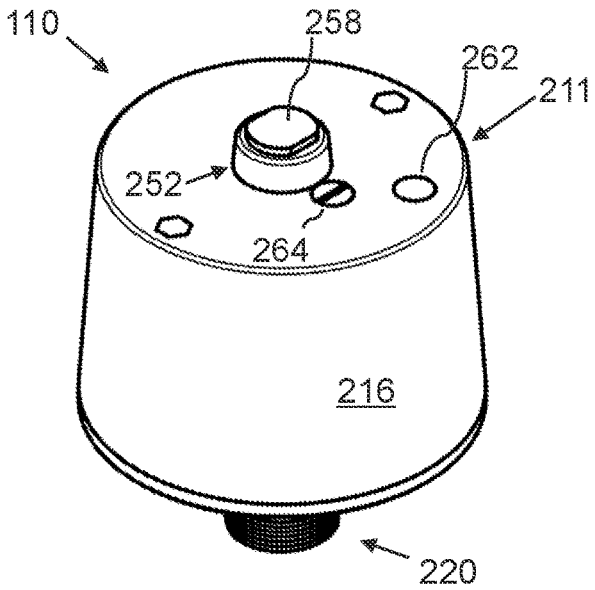
FIG. 2A is a top perspective view of a flagpole truck device, according to an embodiment of the invention.
Figure 2B:
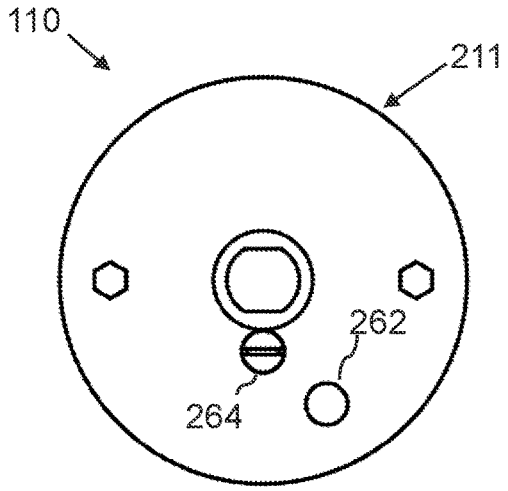
FIG. 2B is a top view of a flagpole truck device, according to an embodiment of the invention.
Figure 2C:
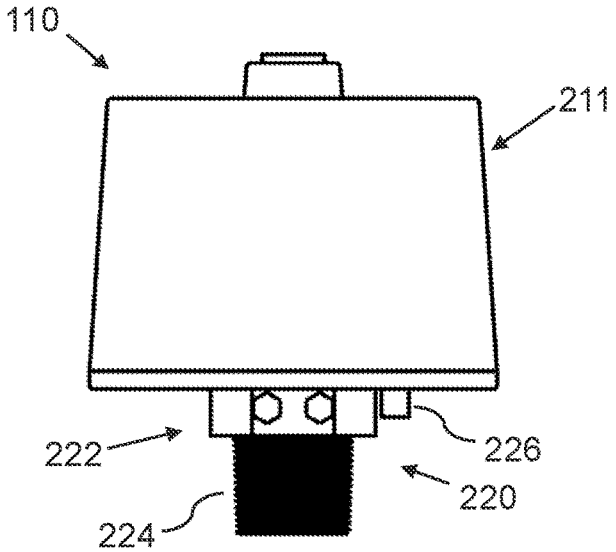
FIG. 2C is a front view of a flagpole truck device, according to an embodiment of the invention.
Figure 2D:
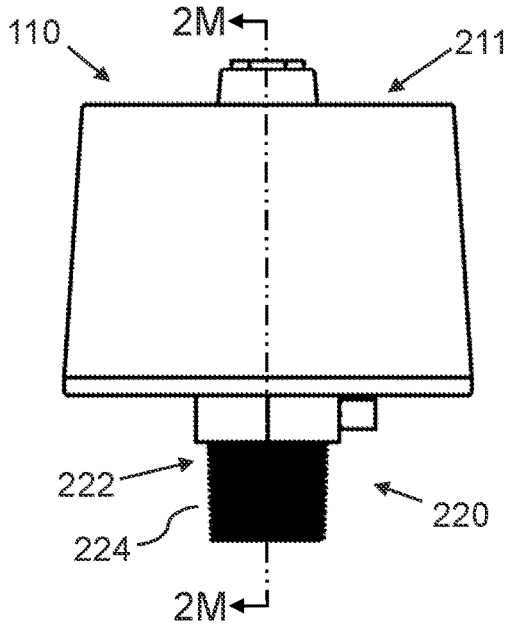
FIG. 2D is a right side view of a flagpole truck device, according to an embodiment of the invention.
Figure 2E:
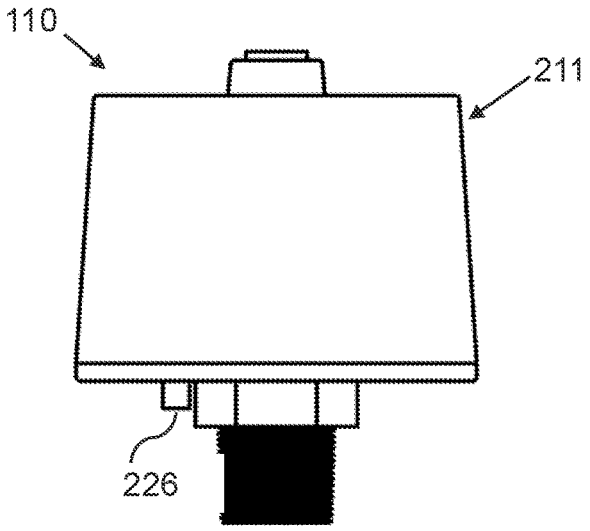
FIG. 2E is a left side view of a flagpole truck device, according to an embodiment of the invention.
Figure 2F:
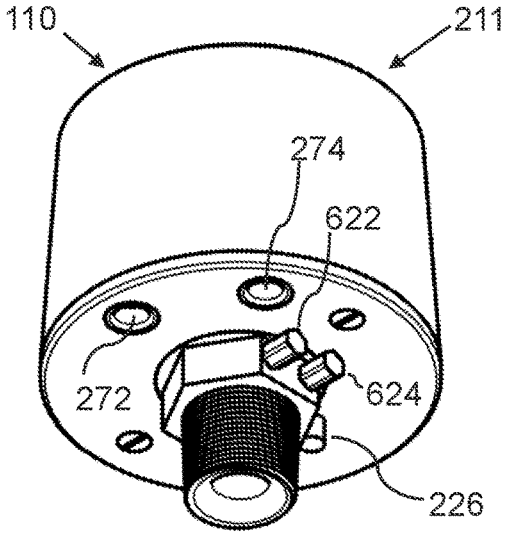
FIG. 2F is a bottom perspective view of a flagpole truck device, according to an embodiment of the invention.
Figure 2G:
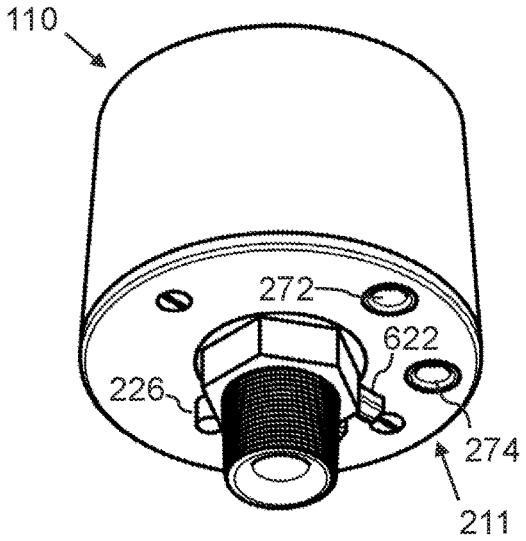
FIG. 2G is a bottom perspective view of a flagpole truck device, according to an embodiment of the invention.
Figure 2H:
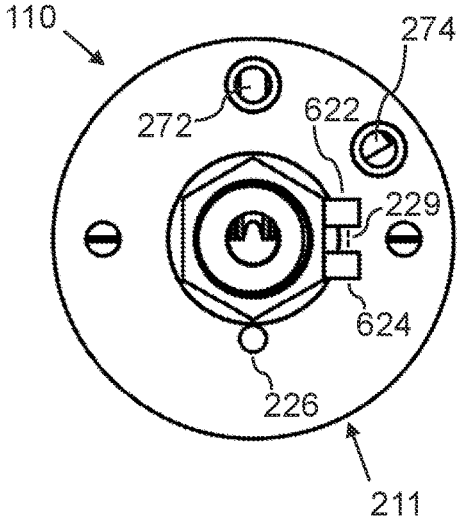
FIG. 2H is a bottom view of a flagpole truck device, according to an embodiment of the invention.
Figure 2I:
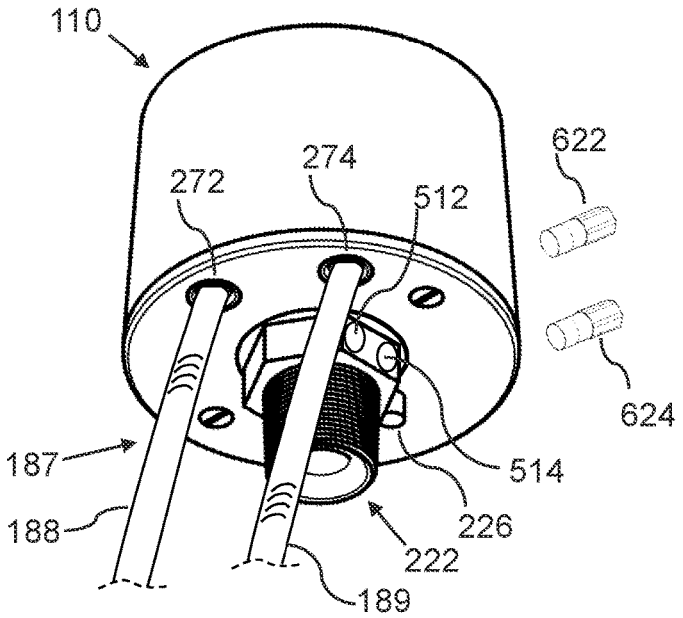
FIG. 2I is a bottom perspective view of a flagpole truck device, according to an embodiment of the invention.
Figure 2J:
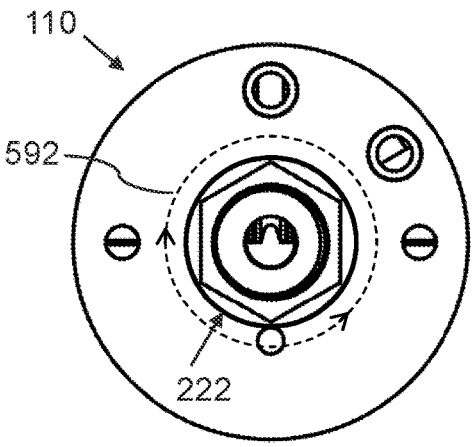
FIG. 2J is a bottom view of a flagpole truck device, according to an embodiment of the invention.
Figure 2K:
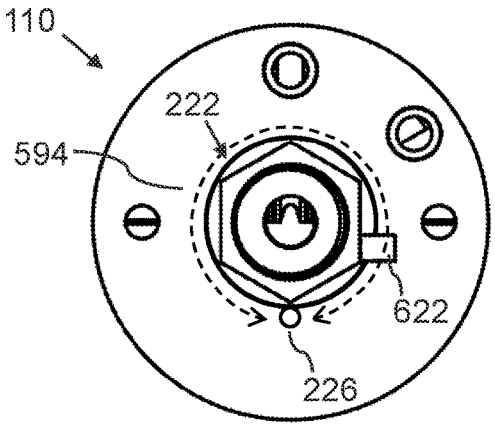
FIG. 2K is a bottom view of a flagpole truck device, according to an embodiment of the invention.
Figure 2L:
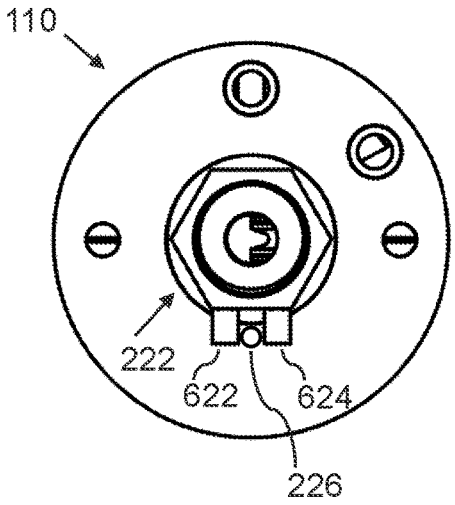
FIG. 2L is a bottom view of a flagpole truck device, according to an embodiment of the invention.

In a related embodiment, as shown in FIGS. 2C-2H, the flagpole truck device 110 can include a blocking protrusion 226, which is connected to a bottom of the enclosure body 211 (i.e., to a bottom of the bottom base plate 232); the mounting stem structure 222 can include a first pin aperture 512 and a second pin aperture 514, which is horizontally displaced (i.e. laterally displaced relative to a vertical/elongated axis of the mounting stem structure 222) to a side of the first pin aperture, wherein the first pin aperture 512 and the second pin aperture 514 are positioned above the outer threading 224; and wherein the mounting stem assembly 220, can further include:

a) a first blocking pin 622, which is configured to be inserted into the first pin aperture 512 (or alternatively the second pin aperture 514), such that the first blocking pin 622 protrudes horizontally from the mounting stem structure 222, such that the first blocking pin 622 is configured to impact with the blocking protrusion 226 to stop a rotation of the mounting stem assembly 220 relative to the enclosure body 211; and b) a second blocking pin 624, which is configured to be inserted into the second pin aperture 512 (or alternatively the first pin aperture 512), such that the second blocking pin 624 protrudes horizontally from the mounting stem structure 222, to a side of the first blocking pin 622 with a separation distance 229 (or separation gap 229), as shown in FIG. 2H, between the first blocking pin 622 and the second blocking pin 624, such that the second blocking pin 624 is configured to impact with the blocking protrusion 226 to stop a rotation of the mounting stem assembly 220 relative to the enclosure body 211;

such that when neither of the first blocking pin 622 and the second blocking pin 624 are inserted in either of the first pin aperture 512 and the second pin aperture 514, the mounting stem assembly 220 is freely rotatable 592 360 degrees in either direction (relative to the enclosure body 211), as shown in FIG. 2J, whereby the enclosure body 211 of the flagpole truck device 110 is freely rotatable when the flagpole truck device 110 is mounted on the flagpole 182;

such that when solely one (i.e., one and only one) selected blocking pin 622, 624 of the first blocking pin 622 and the second blocking pin 624 is inserted in a selected pin aperture 512, 514 of the first pin aperture 512 and the second pin aperture 514, the mounting stem assembly 220 is rotatable in a restricted rotation range 594 in either direction, wherein the restricted rotation range 594 can be 359 degrees or less (depending on size of the selected blocking pin 622, 624), as shown in FIG. 2K, whereby the enclosure body 211 of the flagpole truck device 110 is rotatable in the restricted rotation range when the flagpole truck device 110 is mounted on the flagpole 182; and such that when the first blocking pin 622 is inserted in the first pin aperture, 622 and the second blocking pin 624 is inserted in the second pin aperture 622, with the blocking protrusion 226 positioned between the first blocking pin 622 and the second blocking pin 624, the mounting stem assembly 220 is substantially prevented from rotating (less any minor tolerance gaps allowing slight movement), as shown in FIG. 2L, whereby the enclosure body 211 of the flagpole truck device 110 is substantially rotatably fixed in position when the flagpole truck device 110 is mounted on the flagpole 182, such that rotation is blocked and prevented.

In another related embodiment, a top of the enclosure body 211 (i.e., the top plate 316) can be configured to include:

a) a first pulley mount 262, which can be a pulley mount aperture 262; and b) a second pulley mount 264, which can be a pulley mount aperture 262, wherein the first pulley mount 262 is positioned on an outward side (closer to the periphery sidewall) of the top of the enclosure body, relative to the second pulley mount 264;

such that the pulley assembly 230 is configured to be connected to the first pulley mount 262 in a first position 391, such that pulley is oriented along a tangent of a peripheral line 381 of an outer periphery of an inner side of the top 316 of the enclosure body 211 (wherein the peripheral line 381 is perpendicular to a radius line 382 of the enclosure body 211), as shown in FIG. 3E; and such that the pulley assembly 230 is configured to be connected to the second pulley mount 264 in a second position 392, such that the pulley assembly 230 is oriented along a radius line 382 of the inner side of the top of the enclosure body 211 (from a center of the top plate 316 to a periphery of the top plate 316, wherein the radius line 382 is perpendicular to the tangent of the peripheral line 381), as shown in FIGS. 3E and 3F.

In another related embodiment, a bottom of the enclosure body 211 (i.e, the bottom base plate 232) can be configured to include:

a) a first halyard aperture 272; and b) a second halyard aperture 274;

such that when a halyard 187 is mounted in the pulley assembly 230, when the pulley assembly 230 is configured in the first position 391, a first end 188 of the halyard 187 can be configured to protrude through the first halyard aperture 272 and a second end 189 of the halyard 187 can be configured to protrude through the second halyard aperture 274, as shown in FIGS. 21 and 3E;

such that a first end 188 (of the halyard 187) and a second end 189 of the halyard 187 each protrude downward from the flagpole truck device 110 externally and visibly, to a side of the flagpole 182.

Figure 2M:
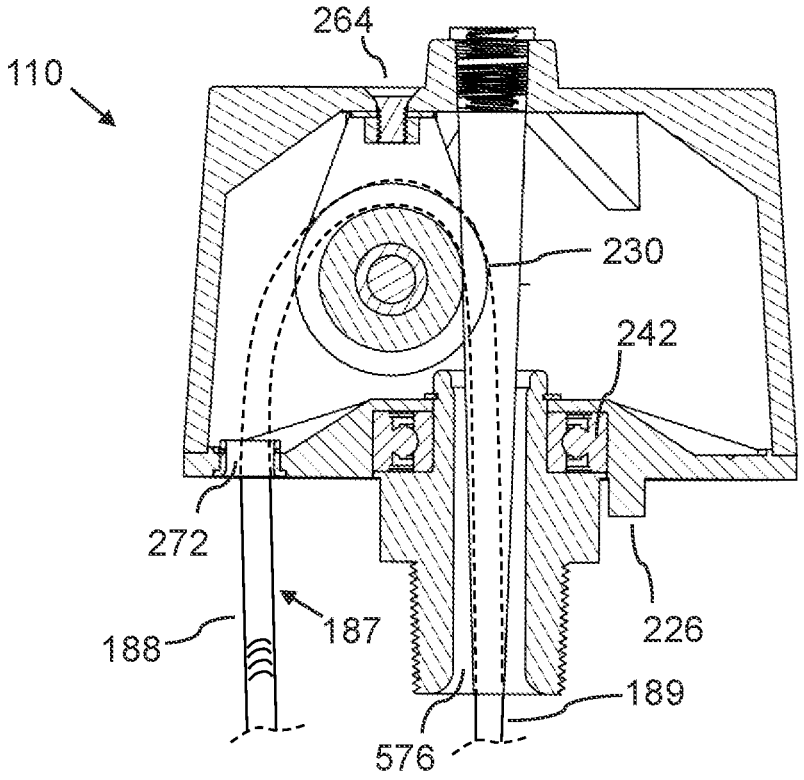
FIG. 2M is a cross-sectional view of a flagpole truck device taken along section line 2M-2M of FIG. 2D, according to an embodiment of the invention.
Figure 2N:
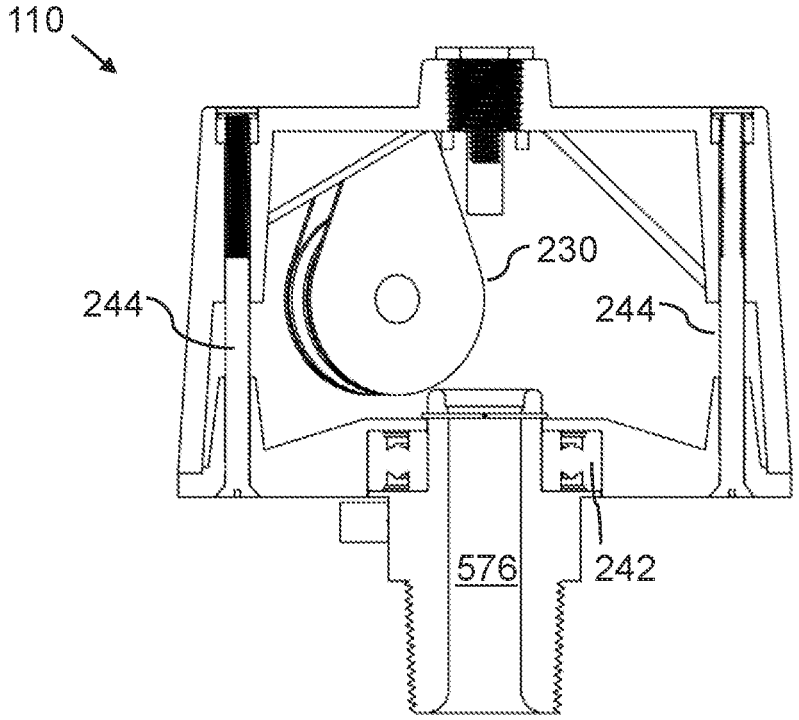
FIG. 2N is a sectional cut view of a flagpole truck device showing an interior of the flagpole truck device, according to an embodiment of the invention.

In a further related embodiment, the mounting stem structure 222 can be configured with (i.e. further include):

a) a vertical protruding aperture 576 (as shown in FIGS. 5A-5D), which protrudes vertically through the mounting stem structure 222;

such that when a halyard 187 is mounted in the pulley assembly 230, when the pulley assembly 230 is configured in the second position 392, a first end 188 of the halyard 187 can be configured to protrude through the a selected halyard aperture 272, 274 (of the first halyard aperture 272 and the second halyard aperture 274) and a second end 189 of the halyard 187 can be configured to protrude through the vertical protruding aperture 576 of the mounting stem structure 222, as shown in FIG. 2M, such that the second end 189 of the halyard 187 protrudes into a hollow interior of the flagpole 182, when the mounting stem structure 222 is connected to the flagpole 182;

such that the first end 188 of the halyard 187 protrudes downward externally and visibly, to a side of the flagpole 182, and the second end 189 of the halyard 187 protrudes downward inside of an upper portion of the hollow flagpole 182.

In various related embodiments, the flagpole truck device 110 can further include:

a) a bearing 242, which can be a ball bearing 242;

wherein the bearing 242 can be mounted between the enclosure body 211 and the mounting stem structure 222, such that the enclosure body 211 is rotatable relative to the mounting stem structure 222, wherein the bearing 242 can be mounted between an upper protruding portion of enclosure body 211 and the bottom base plate 232 of the mounting stem structure 222, such that the bearing 242 is mounted inside an indentation of the bottom base plate 232; and b) at least two mounting bolts 244 with corresponding nuts, which are configured to connect the upper body portion 212 and the bottom base plate 232 securely together.

Figure 7A:
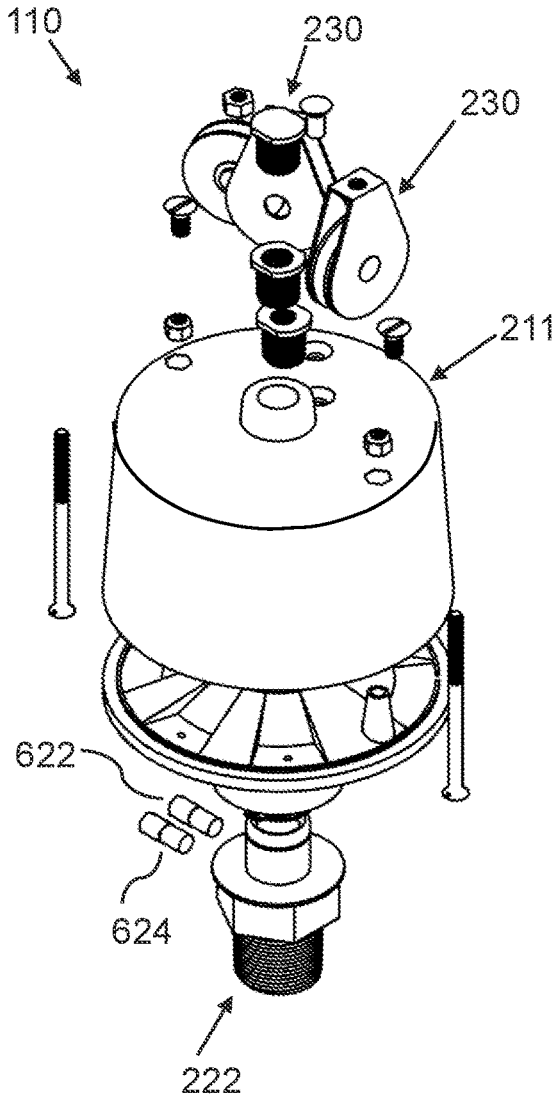
FIG. 7A is a top exploded perspective view of parts of a flagpole truck device, according to an embodiment of the invention.
Figure 7B:
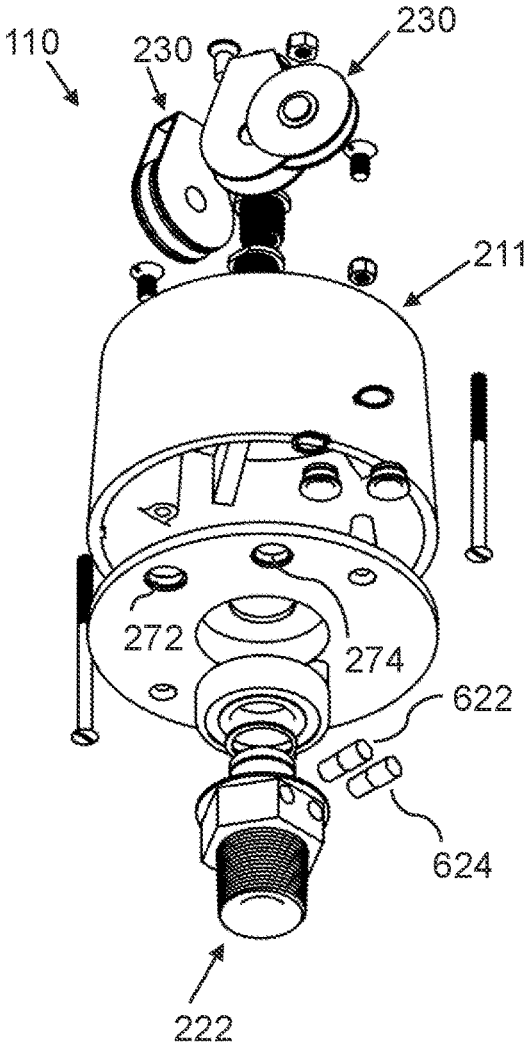
FIG. 7B is a bottom exploded perspective view of parts of a flagpole truck device, according to an embodiment of the invention.

In a related embodiment, FIGS. 7A and 7B, show respectively top and bottom exploded views of parts of the flagpole truck device 110. Note that the pulley assembly 130 is shown twice in both FIGS. 7A and 7B, to show relative parts orientation in the first position 191 and the second position 192 of the pulley assembly 130.

In related embodiments, the flagpole truck device 110 can be configured to universally mount to different flagpoles 182, as provided by various manufacturers.

In related embodiments, the flagpole truck device 110 can be configured to universally mount to different flagpoles 182, as provided by various manufacturers.

Here has thus been described a multitude of embodiments of the flagpole truck device 110, the flagpole truck system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A flagpole truck system, comprising:

a) a flagpole, such that a lower end of the flagpole is configured to be mounted on a ground surface;

b) a flagpole truck device, which is mounted on a top end of the flagpole, wherein the flagpole truck device, further comprises:

a pulley assembly, which is mounted inside an enclosure interior of the flagpole truck device;

c) a flag, which is mounted on a top part of the flagpole; and d) a halyard, which is connected around the pulley assembly inside the flagpole truck device, wherein the halyard is connected to the flag, such that a movement of the halyard enables positioning of the flag;

such that the flagpole truck device is configurable in a first configuration, wherein the pulley assembly is positioned in a first position, such that a first end of the halyard and a second end of the halyard each protrude downward from the flagpole truck device externally and visibly, to a side of the flagpole; and such that the flagpole truck device is configurable in a second configuration, wherein the pulley assembly is positioned in a second position, such that the first end of the halyard protrudes downward from the flagpole truck device externally and visibly, to a side of the flagpole, and such that the second end of the halyard protrudes downward from the flagpole truck device inside a hollow interior of the flagpole.

2. The flagpole truck system of claim 1, further comprising:

a flagpole finial, which is connected to a top of the flagpole truck device.

3. The flagpole truck system of claim 1, wherein the flagpole truck device further comprises:

a) an enclosure body, which comprises the enclosure interior; and b) a mounting stem assembly, which comprises:

a mounting stem structure;

wherein an upper end of the mounting stem structure is rotatably connected to a bottom center of the enclosure body;

wherein the mounting stem structure is connected to the top end of the flagpole, such that the enclosure body is rotatably connected to the top end of the flagpole.

4. The flagpole truck system of claim 3, wherein the mounting stem structure is configured with an outer threading on a lower portion of the mounting stem structure, such that the lower portion of the mounting stem structure is screwed into a threaded aperture of the top end of the flagpole.

5. The flagpole truck system of claim 3, wherein:

a) the flagpole truck device further comprises:

a blocking protrusion, which is connected to a bottom of the enclosure body;

b) the mounting stem structure further comprises:

a first pin aperture; and a second pin aperture, which is horizontally displaced to a side of the first pin aperture; and c) the mounting stem assembly, further comprises:

a first blocking pin, which is configured to be inserted into the first pin aperture, such that the first blocking pin protrudes horizontally from the mounting stem structure, such that the first blocking pin is configured to impact with the blocking protrusion to stop a rotation of the mounting stem assembly relative to the enclosure body; and a second blocking pin, which is configured to be inserted into the second pin aperture, such that the second blocking pin protrudes horizontally from the mounting stem structure to a side of the first blocking pin, with a separation distance between the first blocking pin and the second blocking pin, such that the second blocking pin is configured to impact with the blocking protrusion to stop the rotation of the mounting stem assembly relative to the enclosure body;

such that when neither of the first blocking pin and the second blocking pin are inserted in either of the first pin aperture and the second pin aperture, the mounting stem assembly is freely rotatable 360 degrees in either direction, whereby the enclosure body of the flagpole truck device is freely rotatable;

such that when solely one selected blocking pin of the first blocking pin and the second blocking pin is inserted in a selected pin aperture of the first pin aperture and the second pin aperture, the mounting stem assembly is rotatable in a restricted rotation range in either direction, wherein the restricted rotation range is 359 degrees or less, whereby the enclosure body of the flagpole truck device is rotatable in the restricted rotation range; and such that when the first blocking pin is inserted in the first pin aperture, and the second blocking pin is inserted in the second pin aperture, with the blocking protrusion positioned between the first blocking pin and the second blocking pin, the mounting stem assembly is prevented from rotating, whereby the enclosure body of the flagpole truck device is rotatably fixed in position.

6. The flagpole truck system of claim 3, wherein a top of the enclosure body further comprises:

a) a first pulley mount; and b) a second pulley mount;

wherein the first pulley mount is positioned on an outward side of the top of the enclosure body, relative to the second pulley mount;

such that the pulley assembly is configured to be connected to the first pulley mount in the first position, such that the pulley assembly is oriented along a tangent of a peripheral line of an outer periphery of an inner side of the top of the enclosure body, wherein the tangent of the peripheral line is perpendicular to a radius line of the inner side of the top of the enclosure body;

such that the pulley assembly is configured to be connected to the second pulley mount in the second position, such that the pulley assembly is oriented along the radius line of the inner side of the top of the enclosure body.

7. The flagpole truck system of claim 6, wherein the first pulley mount is configured as a first pulley mount aperture and the second pulley mount is configured as a second pulley mount aperture.

8. The flagpole truck system of claim 6, wherein a bottom of the enclosure body further comprises:

a) a first halyard aperture; and b) a second halyard aperture;

such that when the halyard is mounted in the pulley assembly, when the pulley assembly is configured in the first position, the first end of the halyard is configurable to protrude through the first halyard aperture and the second end of the halyard is configurable to protrude through the second halyard aperture.

9. The flagpole truck system of claim 8, wherein the mounting stem structure further comprises:

a vertical protruding aperture, which protrudes vertically through the mounting stem structure;

such that when the halyard is mounted in the pulley assembly, when the pulley assembly is configured in the second position, the first end of the halyard is configurable to protrude through a selected halyard aperture of the first halyard aperture and the second halyard aperture, and the second end of the halyard is configurable to protrude through the vertical protruding aperture of the mounting stem structure, such that the second end of the halyard protrudes into the hollow interior of the flagpole.

10. A flagpole truck system, comprising:

a flagpole truck device, which is configured to be mounted on a top end of a flagpole mounted on a ground surface, wherein the flagpole truck device, further comprises:

a pulley assembly, which is mounted inside an enclosure interior of the flagpole truck device;

such that the flagpole truck device is configured to receive a halyard, which is connected around the pulley assembly inside the flagpole truck device;

such that the flagpole truck device is configurable in a first configuration, wherein the pulley assembly is positioned in a first position, such that a first end of the halyard and a second end of the halyard each protrude downward from the flagpole truck device externally and visibly, to a side of the flagpole; and such that the flagpole truck device is configurable in a second configuration, wherein the pulley assembly is positioned in a second position, such that the first end of the halyard protrudes downward from the flagpole truck device externally and visibly, to a side of the flagpole, and such that the second end of the halyard protrudes downward from the flagpole truck device inside a hollow interior of the flagpole.

11. The flagpole truck system of claim 10, wherein the flagpole truck device further comprises:

a) an enclosure body, which comprises the enclosure interior; and b) a mounting stem assembly, which comprises, a mounting stem structure;

wherein an upper end of the mounting stem structure is rotatably connected to a bottom center of the enclosure body;

wherein the mounting stem structure is configured to connect to the top end of the flagpole, such that the enclosure body is rotatably connected to the top end of the flagpole.

12. The flagpole truck system of claim 11, wherein the mounting stem structure is configured with an outer threading on a lower portion of the mounting stem structure, such that the lower portion of the mounting stem structure is configured to be screwed into a threaded aperture of the top end of the flagpole.

13. The flagpole truck system of claim 11, wherein:

a) the flagpole truck device further comprises:

a blocking protrusion, which is connected to a bottom of the enclosure body;

b) the mounting stem structure further comprises:

a first pin aperture; and a second pin aperture, which is horizontally displaced to a side of the first pin aperture; and c) the mounting stem assembly, further comprises:

a first blocking pin, which is configured to be inserted into the first pin aperture, such that the first blocking pin protrudes horizontally from the mounting stem structure, such that the first blocking pin is configured to impact with the blocking protrusion to stop a first rotation of the mounting stem assembly relative to the enclosure body; and a second blocking pin, which is configured to be inserted into the second pin aperture, such that the second blocking pin protrudes horizontally from the mounting stem structure to a side of the first blocking pin, with a separation distance between the first blocking pin and the second blocking pin, such that the second blocking pin is configured to impact with the blocking protrusion to stop a second rotation of the mounting stem assembly relative to the enclosure body;

such that when neither of the first blocking pin and the second blocking pin are inserted in either of the first pin aperture and the second pin aperture, the mounting stem assembly is freely rotatable 360 degrees in either direction, whereby the enclosure body of the flagpole truck device is freely rotatable when the flagpole truck device is mounted on the flagpole;

such that when solely one selected blocking pin of the first blocking pin and the second blocking pin is inserted in a selected pin aperture of the first pin aperture and the second pin aperture, the mounting stem assembly is rotatable in a restricted rotation range in either direction, wherein the restricted rotation range is 359 degrees or less, whereby the enclosure body of the flagpole truck device is rotatable in the restricted rotation range when the flagpole truck device is mounted on the flagpole; and such that when the first blocking pin is inserted in the first pin aperture, and the second blocking pin is inserted in the second pin aperture, with the blocking protrusion positioned between the first blocking pin and the second blocking pin, the mounting stem assembly is prevented from rotating, whereby the enclosure body of the flagpole truck device is rotatably fixed in position when the flagpole truck device is mounted on the flagpole.

14. The flagpole truck system of claim 11, wherein a top of the enclosure body further comprises:

a) a first pulley mount; and b) a second pulley mount;

wherein the first pulley mount is positioned on an outward side of the top of the enclosure body, relative to the second pulley mount;

such that the pulley assembly is configured to be connected to the first pulley mount in the first position, such that the pulley assembly is oriented along a tangent of a peripheral line of an outer periphery of an inner side of the top of the enclosure body, wherein the tangent of the peripheral line is perpendicular to a radius line of the inner side of the enclosure body;

such that the pulley assembly is configured to be connected to the second pulley mount in the second position, such that the pulley assembly is oriented along the radius line of the inner side of the enclosure body.

15. The flagpole truck system of claim 14, wherein the first pulley mount is configured as a first pulley mount aperture and the second pulley mount is configured as a second pulley mount aperture.

16. The flagpole truck system of claim 14, wherein a bottom of the enclosure body further comprises:

a) a first halyard aperture; and b) a second halyard aperture;

such that when the halyard is mounted in the pulley assembly, when the pulley assembly is configured in the first position, the first end of the halyard is configurable to protrude through the first halyard aperture and the second end of the halyard is configurable to protrude through the second halyard aperture.

17. The flagpole truck system of claim 16, wherein the mounting stem structure further comprises:

a vertical protruding aperture, which protrudes vertically through the mounting stem structure;

such that when the halyard is mounted in the pulley assembly, when the pulley assembly is configured in the second position, the first end of the halyard is configurable to protrude through a selected halyard aperture of the first halyard aperture and the second halyard aperture, and the second end of the halyard is configurable to protrude through the vertical protruding aperture of the mounting stem structure, such that the second end of the halyard protrudes into the hollow interior of the flagpole, when the mounting stem structure is connected to the flagpole.

18. A flagpole truck system, comprising:

a flagpole truck device, which is configured to be mounted on a top end of a flagpole mounted on a ground surface, wherein the flagpole truck device, further comprises:

an enclosure body, which comprises an enclosure interior;

a mounting stem assembly, which comprises, a mounting stem structure;

wherein an upper end of the mounting stem structure is rotatably connected to a bottom center of the enclosure body; and a pulley assembly, which is mounted inside the enclosure interior;

wherein the mounting stem structure is configured to connect to the top end of the flagpole, such that the enclosure body is rotatably connected to the top end of the flagpole;

such that the flagpole truck device is configured to receive a halyard, which is connected around the pulley assembly inside the flagpole truck device;

wherein the mounting stem structure is configured with an outer threading on a lower portion of the mounting stem structure, such that the lower portion of the mounting stem structure is configured to be screwed into a threaded aperture of the top end of the flagpole.

19. The flagpole truck system of claim 18, wherein:

a) the flagpole truck device further comprises:

a blocking protrusion, which is connected to a bottom of the enclosure body;

b) the mounting stem structure further comprises:

a first pin aperture; and a second pin aperture, which is horizontally displaced to a side of the first pin aperture; and c) the mounting stem assembly, further comprises:

a first blocking pin, which is configured to be inserted into the first pin aperture, such that the first blocking pin protrudes horizontally from the mounting stem structure, such that the first blocking pin is configured to impact with the blocking protrusion to stop a first rotation of the mounting stem assembly relative to the enclosure body; and a second blocking pin, which is configured to be inserted into the second pin aperture, such that the second blocking pin protrudes horizontally from the mounting stem structure to a side of the first blocking pin, with a separation distance between the first blocking pin and the second blocking pin, such that the second blocking pin is configured to impact with the blocking protrusion to stop a second rotation of the mounting stem assembly relative to the enclosure body;

such that when neither of the first blocking pin and the second blocking pin are inserted in either of the first pin aperture and the second pin aperture, the mounting stem assembly is freely rotatable 360 degrees in either direction, whereby the enclosure body of the flagpole truck device is freely rotatable when the flagpole truck device is mounted on the flagpole;

such that when solely one selected blocking pin of the first blocking pin and the second blocking pin is inserted in a selected pin aperture of the first pin aperture and the second pin aperture, the mounting stem assembly is rotatable in a restricted rotation range in either direction, wherein the restricted rotation range is 359 degrees or less, whereby the enclosure body of the flagpole truck device is rotatable in the restricted rotation range when the flagpole truck device is mounted on the flagpole; and such that when the first blocking pin is inserted in the first pin aperture, and the second blocking pin is inserted in the second pin aperture, with the blocking protrusion positioned between the first blocking pin and the second blocking pin, the mounting stem assembly is prevented from rotating, whereby the enclosure body of the flagpole truck device is rotatably fixed in position when the flagpole truck device is mounted on the flagpole.

20. The flagpole truck system of claim 18, wherein the flagpole truck device is configurable in a first configuration, wherein the pulley assembly is positioned in a first position, such that a first end of the halyard and a second end of the halyard each protrude downward from the flagpole truck device externally and visibly, to a side of the flagpole; and the flagpole truck device is configurable in a second configuration, wherein the pulley assembly is positioned in a second position, such that the first end of the halyard protrudes downward from the flagpole truck device externally and visibly, to a side of the flagpole, and such that the second end of the halyard protrudes downward from the flagpole truck device inside a hollow interior of the flagpole.

21. The flagpole truck system of claim 20, wherein a top of the enclosure body further comprises:

a) a first pulley mount; and b) a second pulley mount;

wherein the first pulley mount is positioned on an outward side of the top of the enclosure body, relative to the second pulley mount;

such that the pulley assembly is configured to be connected to the first pulley mount in the first position, such that the pulley assembly is oriented along a tangent of a peripheral line of an outer periphery of an inner side of the top of the enclosure body, wherein the tangent of the peripheral line is perpendicular to a radius line of the inner side of the enclosure body;

such that the pulley assembly is configured to be connected to the second pulley mount in the second position, such that the pulley assembly is oriented along the radius line of the inner side of the enclosure body.

22. The flagpole truck system of claim 21, wherein the first pulley mount is configured as a first pulley mount aperture and the second pulley mount is configured as a second pulley mount aperture.

23. The flagpole truck system of claim 21, wherein a bottom of the enclosure body further comprises:

a) a first halyard aperture; and b) a second halyard aperture;

such that when the halyard is mounted in the pulley assembly, when the pulley assembly is configured in the first position, the first end of the halyard is configurable to protrude through the first halyard aperture and the second end of the halyard is configurable to protrude through the second halyard aperture.

24. The flagpole truck system of claim 23, wherein the mounting stem structure further comprises:

a vertical protruding aperture, which protrudes vertically through the mounting stem structure;

such that when the halyard is mounted in the pulley assembly, when the pulley assembly is configured in the second position, the first end of the halyard is configurable to protrude through a selected halyard aperture of the first halyard aperture and the second halyard aperture, and the second end of the halyard is configurable to protrude through the vertical protruding aperture of the mounting stem structure, such that the second end of the halyard protrudes into the hollow interior of the flagpole, when the mounting stem structure is connected to the flagpole.

25. A flagpole truck system, comprising:

a flagpole truck device, which is configured to be mounted on a top end of a flagpole mounted on a ground surface, wherein the flagpole truck device, further comprises:

an enclosure body, which comprises an enclosure interior;

a mounting stem assembly, which comprises, a mounting stem structure, wherein the mounting stem structure further comprises:

a first pin aperture; and a second pin aperture, which is horizontally displaced to a side of the first pin aperture;

wherein an upper end of the mounting stem structure is rotatably connected to a bottom center of the enclosure body;

a pulley assembly, which is mounted inside the enclosure interior; and a blocking protrusion, which is connected to a bottom of the enclosure body;

wherein the mounting stem structure is configured to connect to the top end of the flagpole, such that the enclosure body is rotatably connected to the top end of the flagpole;

such that the flagpole truck device is configured to receive a halyard, which is connected around the pulley assembly inside the flagpole truck device;

wherein the mounting stem assembly, further comprises:

a first blocking pin, which is configured to be inserted into the first pin aperture, such that the first blocking pin protrudes horizontally from the mounting stem structure, such that the first blocking pin is configured to impact with the blocking protrusion to stop a first rotation of the mounting stem assembly relative to the enclosure body; and a second blocking pin, which is configured to be inserted into the second pin aperture, such that the second blocking pin protrudes horizontally from the mounting stem structure to a side of the first blocking pin, with a separation distance between the first blocking pin and the second blocking pin, such that the second blocking pin is configured to impact with the blocking protrusion to stop a second rotation of the mounting stem assembly relative to the enclosure body;

such that when neither of the first blocking pin and the second blocking pin are inserted in either of the first pin aperture and the second pin aperture, the mounting stem assembly is freely rotatable 360 degrees in either direction, whereby the enclosure body of the flagpole truck device is freely rotatable when the flagpole truck device is mounted on the flagpole;

such that when solely one selected blocking pin of the first blocking pin and the second blocking pin is inserted in a selected pin aperture of the first pin aperture and the second pin aperture, the mounting stem assembly is rotatable in a restricted rotation range in either direction, wherein the restricted rotation range is 359 degrees or less, whereby the enclosure body of the flagpole truck device is rotatable in the restricted rotation range when the flagpole truck device is mounted on the flagpole; and such that when the first blocking pin is inserted in the first pin aperture, and the second blocking pin is inserted in the second pin aperture, with the blocking protrusion positioned between the first blocking pin and the second blocking pin, the mounting stem assembly is prevented from rotating, whereby the enclosure body of the flagpole truck device is rotatably fixed in position when the flagpole truck device is mounted on the flagpole.

* * * * *